US011094264B2

(12) United States Patent
In

(10) Patent No.: US 11,094,264 B2
(45) Date of Patent: Aug. 17, 2021

(54) DISPLAY DEVICE

(71) Applicant: Samsung Display Co., Ltd., Yongin-si (KR)

(72) Inventor: Hai Jung In, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/683,193

(22) Filed: Nov. 13, 2019

(65) Prior Publication Data

US 2020/0211466 A1 Jul. 2, 2020

(30) Foreign Application Priority Data

Dec. 26, 2018 (KR) ..... 10-2018-0169607

(51) Int. Cl.
*G09G 3/3266* (2016.01)

(52) U.S. Cl.
CPC ... *G09G 3/3266* (2013.01); *G09G 2310/0243* (2013.01); *G09G 2310/08* (2013.01); *G09G 2320/0223* (2013.01); *G09G 2330/04* (2013.01)

(58) Field of Classification Search
CPC ..... G09G 3/3266; G09G 2310/08; G09G 2310/0243; G09G 2330/04; G09G 2320/0223; G09G 2310/0286; G09G 2310/0267; G09G 3/2096; G09G 3/2077
See application file for complete search history.

(56) References Cited

U.S. PATENT DOCUMENTS

| | | | | |
|---|---|---|---|---|
| 7,868,868 | B2 | 1/2011 | Kim et al. | |
| 8,290,115 | B2 | 10/2012 | Kim et al. | |
| 9,001,108 | B2 | 4/2015 | Jang | |
| 9,105,225 | B2 | 8/2015 | Kim | |
| 9,117,512 | B2 | 8/2015 | Nam et al. | |
| 9,330,593 | B2 | 5/2016 | Jang | |
| 2013/0314392 | A1* | 11/2013 | Kim | G09G 3/3266 345/212 |

FOREIGN PATENT DOCUMENTS

| | | |
|---|---|---|
| KR | 10-1074417 | 10/2011 |
| KR | 10-2013-0130999 | 12/2013 |
| KR | 10-2014-0036729 | 3/2014 |
| KR | 10-2014-0038148 | 3/2014 |
| KR | 10-1808338 | 12/2017 |

* cited by examiner

*Primary Examiner* — David D Davis
(74) *Attorney, Agent, or Firm* — H.C. Park & Associates, PLC

(57) ABSTRACT

A display device includes: a display panel having a plurality of pixels coupled to respective ones of first to nth (where n is a natural number of 1 or more) scan lines; a scan driver having a plurality of stages to supply a scan signal to the first to nth scan lines; and a timing controller to provide a clock signal to the scan driver, the timing controller controlling the scan driver by controlling an overdriving pulse of the clock signal. A first overdriving pulse of the clock signal corresponding to a first scan signal is different from an nth overdriving pulse of the clock signal corresponding to the nth scan signal.

20 Claims, 10 Drawing Sheets

DISPLAY DEVICE

CROSS-REFERENCE TO RELATED APPLICATION

This application claims priority from and the benefit of Korean Patent Application No. 10-2018-0169607 filed on Dec. 26, 2018, which is hereby incorporated by reference for all purposes as if fully set forth herein.

BACKGROUND

Field

Exemplary implementations of the invention relate generally to a display device, and more particularly, to a display device capable of controlling overdriving of clock signals used to generate scan signals output from a scan driver.

Discussion of the Background

A display device includes a data driver for supplying a data signal to data lines, a scan driver for supplying a scan signal to scan lines, an emission driver for supplying an emission control signal to emission control lines, and pixels coupled to the data lines, the scan lines, and the emission control lines.

The scan driver includes a shift register or scan driving circuit configured with a plurality of stages subordinately coupled to each other. The scan driver may receive a plurality of driving voltages or a plurality of control signals to generate a scan signal.

A driving voltage may include a gate-on voltage at which a switching element can be turned on and a gate-off voltage at which the switching element can be turned off. A control signal may include a scan start signal for instructing scan start and clock signals for controlling a pulse output time of the scan signal.

However, RC delay varies depending on the position of a stage and/or a scan line relative to the device that generates timing signals, and therefore, a variation in scan signal output from the scan driver may occur. This variation may result in delay of the falling time or rising time of the scan signal output.

The above information disclosed in this Background section is only for understanding of the background of the inventive concepts, and, therefore, it may contain information that does not constitute prior art.

SUMMARY

Display devices constructed according to the principles and exemplary implementations of the invention are capable of controlling overdriving of a clock signal based on the distance between a scan line and a timing signal generator (e.g., timing controller). For example, when a stage of the scan driver is close to the timing controller that supplies a clock signal, an overdriving time corresponding to the stage may be shortened to account for minimum RC delay. Accordingly, unnecessary overcharge of the output of a scan line relatively close to the timing controller can be reduced or prevented, and power consumption due to overdriving also can be reduced. Similarly, when a stage of the scan driver is remote from the timing controller that supplies a clock signal, an overdriving time corresponding to the stage may be increased shortened to account for the increased RC delay. Appropriate control of overcharging in accordance with the principles of the invention also can reduce signal noise in the scan signals and/or equalize the scan signal outputs of all the scan lines, thereby improving image quality.

Additional features of the inventive concepts will be set forth in the description which follows, and in part will be apparent from the description, or may be learned by practice of the inventive concepts.

According to an aspect of the invention, a display device includes: a display panel having a plurality of pixels coupled to respective ones of first to nth (where n is a natural number of 1 or more) scan lines; a scan driver having a plurality of stages to supply a scan signal to the first to nth scan lines; and a timing controller to provide a clock signal to the scan driver, the timing controller controlling the scan driver by controlling an overdriving pulse of the clock signal, wherein a first overdriving pulse of the clock signal corresponding to a first scan signal is different from an nth overdriving pulse of the clock signal corresponding to the nth scan signal.

The overdriving pulse may have an overdriving width that decreases from the time of supplying the first scan signal to the time of supplying the nth scan signal.

The overdriving pulse may have an overdriving width that increases from the time of supplying the first scan signal to the time of supplying the nth scan signal.

The first overdriving pulse of the clock signal may have a first overdriving width that is greater than the nth overdriving pulse of the clock signal.

The distance between the first scan line and the timing controller may be greater than that between the nth scan line and the timing controller.

The first overdriving pulse of the clock signal may have a first overdriving width that is smaller than nth overdriving pulse of the clock signal.

The distance between the first scan line and the timing controller may be shorter than that between the nth scan line and the timing controller.

The clock signal may include a first voltage and a second voltage greater than the first voltage. The overdriving pulse of the clock signal may include an undershoot voltage lower than the first voltage and an overshoot voltage higher than the second voltage.

The width of at least one of an undershoot voltage section and an overshoot voltage section may be decreased from the time of supplying the first scan signal to the time of supplying the nth scan signal The timing controller may include a plurality of switches to control a transition timing of the clock signal in response to a plurality of clock control signals.

The magnitude of the undershoot voltage and the magnitude of the overshoot voltage may change from the time of supplying the first scan signal to the time of supplying the nth scan signal in one frame period.

Each of the first voltage and the second voltage may maintain a substantially constant voltage level.

The undershoot voltage may be increased and the overshoot voltage may be decreased from the time of supplying the first scan signal to the time of supplying the nth scan signal in one frame period.

The undershoot voltage corresponding to the first scan line may be lower than that corresponding to the nth scan line.

The overshoot voltage corresponding to the first scan line may be greater than that corresponding to the nth scan line.

The distance between a first stage coupled to the first scan line and the timing controller may be greater than that between an nth stage coupled to the nth scan line and the timing controller.

The display device may further include an electrostatic discharge protector coupled to a clock signal line to transfer the clock signal to the scan driver from the timing controller.

The electrostatic discharge protector may include: a first diode having a first terminal coupled to the clock signal line and a second terminal coupled to a first voltage source to supply the undershoot voltage; and a second diode having a first terminal coupled to a second voltage source to supply the overshoot voltage and a second terminal coupled to the clock signal line.

According to another aspect of the invention, a display device includes: a display panel having a plurality of pixels coupled to respective ones of first to nth (where n is a natural number of 1 or more) scan lines; a scan driver having a plurality of stages to supply a scan signal to the first to nth scan lines; and a timing controller to control the scan driver by controlling an overdriving pulse of a clock signal supplied to the scan driver, wherein the overdriving pulse includes an undershoot voltage and an overshoot voltage, wherein an overdriving width of the clock signal corresponding to an output of the first scan line is greater than that of the clock signal corresponding to an output of the nth scan line.

The distance between a first stage coupled to the first scan line and the timing controller may be greater than that between an nth stage coupled to the nth scan line and the timing controller.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
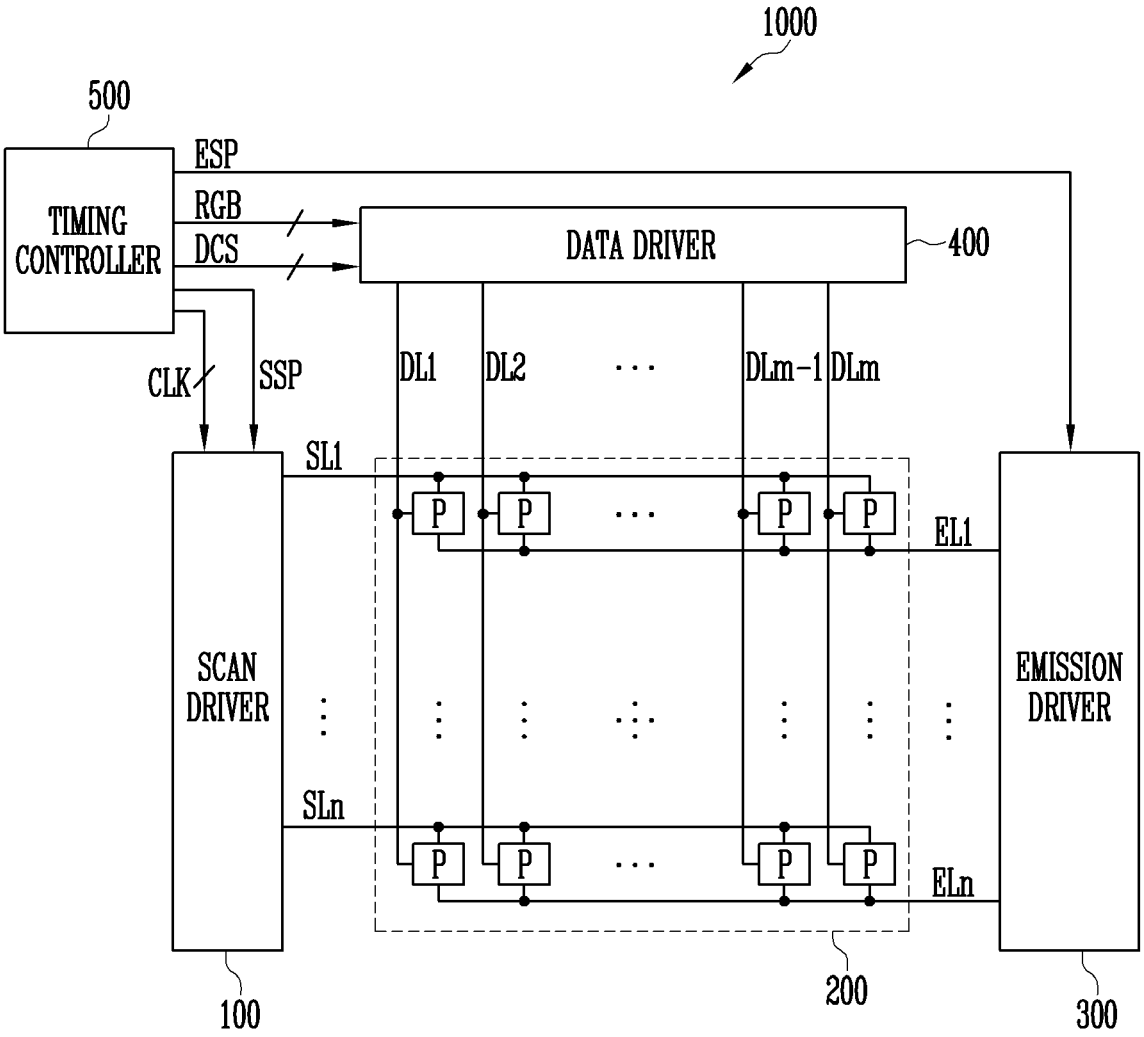
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order.

For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, exemplary embodiments of the invention will be described in more detail with reference to the accompanying drawings. Throughout the drawings, the same reference numerals are given to the same elements, and repetitive descriptions have been omitted to avoid redundancy.

FIG. 1 is a block diagram of an exemplary embodiment of a display device constructed according to the principles of the invention.

Referring to FIG. 1, the display device 1000 may include a display panel 200, a scan driver 100, an emission driver 300, a data driver 400, and a timing controller 500.

The display panel 200 is configured to display an image. The display panel 200 includes a plurality of scan lines SL1 to SLn, a plurality of data lines DL1 to DLm, a plurality of emission control lines EL1 to ELn, and a plurality of pixels P coupled to the scan lines SL1 to SLn, the emission control lines EL1 to ELn, and the data lines DL1 to DLm.

In an exemplary embodiment, each of the number of the scan lines SL1 to SLn and the number of the emission control lines EL1 to ELn may be n. The number of the data lines DL1 to DLm may be m. Here, n and m are natural numbers. Accordingly, the number of the pixels P may be n×m. The display panel 200 may be supplied with a first driving power source ELVDD and a second driving power source ELVSS from the outside (e.g., a power supply).

The timing controller 500 may receive an input control signal and an input image signal from an image source such as an external graphic device. The timing controller 500 may generate a data signal RGB suitable for an operating condition of the display panel 200, based on the input image signal, and provide the data signal RGB to the data driver 400. The timing controller 500 may generate a scan driving control signal for controlling the driving timing of the scan driver 100, an emission driving control signal for controlling the driving timing of the emission driver 300, and a data driving control signal DCS for controlling the driving timing of the data driver 400, based on the input control signal, and provide the scan driving control signal, the emission driving control signal, and the data driving control signal DCS to the scan driver 100, the emission driver 300, and the data driver 400, respectively.

The scan driving control signal may include a scan start signal SSP and clock signals CLK. The scan start signal SSP may control the first timing of a scan signal. The clock signals CLK are used to shift the scan start signal SSP.

In an exemplary embodiment, the clock signals CLK supplied to the scan driver 100 may further include overdriving pulses. As is known in the art, the overdriving pulses may be added to the ordinary clock signals in order to increase or decrease the magnitude or duration of the clock signals CLK from their ordinary values. Accordingly, an RC delay in a signal line for transferring the clock signals CLK can be minimized. Thus, the falling transition time and/or rising transition time of a scan signal output from the scan driver 100 can be reduced. The clock signals CLK generated according to the principles and some exemplary embodiments are illustrated in FIGS. 6-9 and 12-14 as below.

The emission driving control signal may include an emission control start pulse ESP and clock signals. The emission control start pulse ESP may control a first timing of an emission control signal. The clock signals are used to shift the emission control start pulse ESP.

The data driving control signal DCS may include a source start pulse and clock signals. The source start pulse may control a sampling start time of data. The clock signals are used to control a sampling operation.

The scan driver 100 may receive the scan driver control signal from the timing controller 500. The scan driver 100 may supply a scan signal to the scan lines SL1 to SLn in response to the scan driving control signal.

The emission driver 300 may receive the emission driving control signal from the timing controller 500. The emission driver 300 supplies an emission control signal to the emission control lines EL1 to ELn in response to the emission driving control signal.

The data driver 400 may receive the data driving control signal DCS from the timing controller 500. The data driver 400 may supply an analog data signal (data voltage) to the data lines DL1 to DLm in response to the data driving control signal DCS. The data signal supplied to the data lines DL1 to DLm is supplied to pixels P selected by the scan signal.

Figure 2:
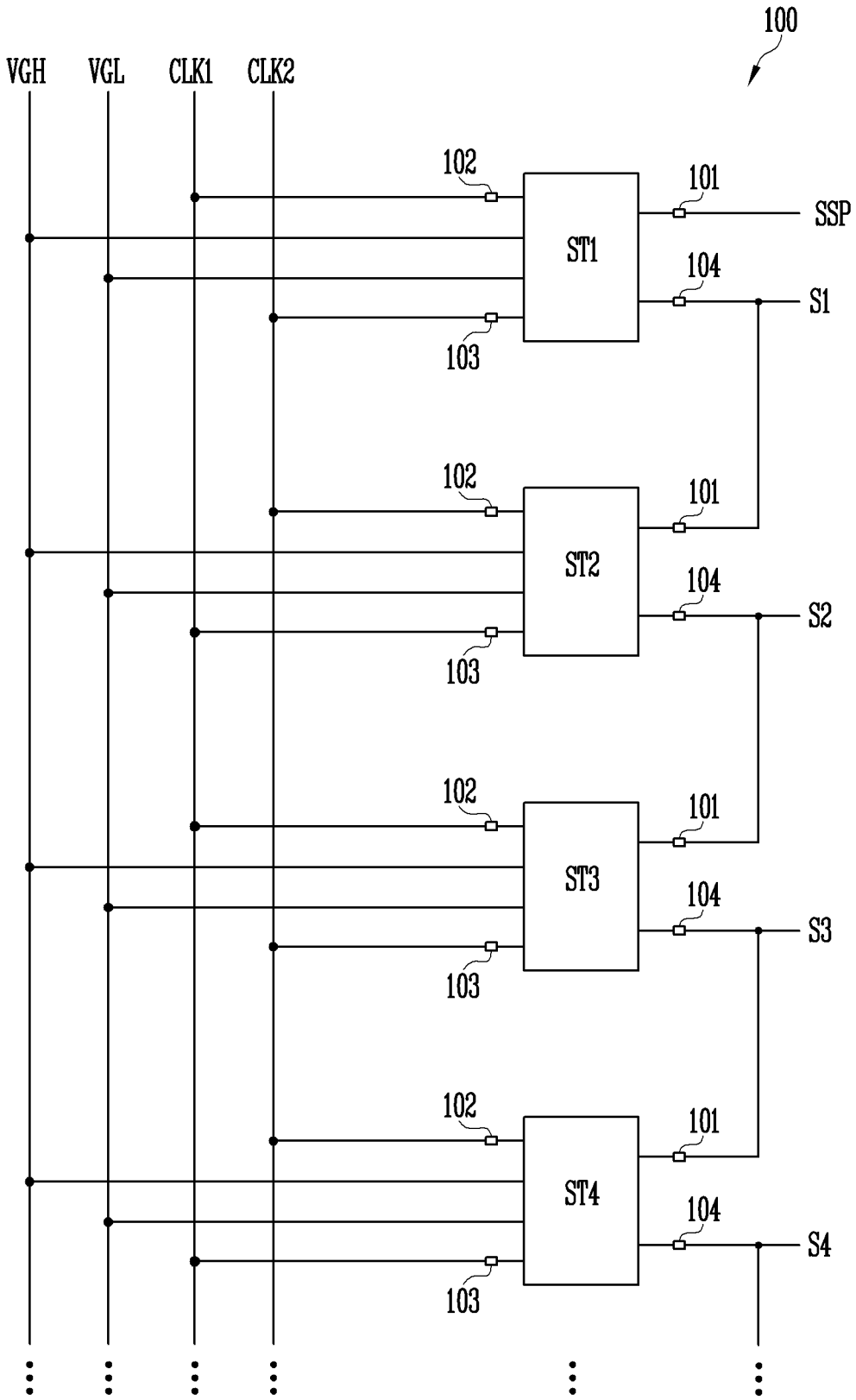
FIG. 2 is a block diagram of an exemplary embodiment of a scan driver included in the display device shown in FIG. 1.

FIG. 2 is a block diagram of an exemplary embodiment of the scan driver included in the display device shown in FIG. 1.

For convenience of description, four stages ST1 to ST4 are described in FIG. 2.

Referring to FIG. 2, the scan driver 100 includes a plurality of stages ST1 to ST4. First to fourth stages ST1 to ST4 are respectively coupled to first to fourth scan lines, and are driven based upon clock signals CLK1 and CLK2. The stages ST1 to ST4 may be configured with the same circuit.

Each of the stages ST1 to ST4 includes a first input terminal 101, a second input terminal 102, a third input terminal 130, and an output terminal 104.

The first input terminal 101 may receive an output signal (i.e., a scan signal) of a previous stage or the scan start signal SSP. In an example, the first input terminal 101 of the first stage ST1 may receive the scan start signal SSP, and the first input terminal 101 of the second stage ST2 may receive a scan signal S1 output from the first stage ST1.

In an exemplary embodiment, the second input terminal 102 of a kth (k is a natural number of n or less) stage may receive a first clock signal CLK1, and the third input terminal 103 of the kth stage may receive a second clock signal CLK2. On the other hand, the second input terminal 102 of a (k+1)th stage may receive the second clock signal CLK2, and the third input terminal 103 of the (k+1)th stage may receive the first clock signal CLK1.

The first clock signal CLK1 and the second clock signal CLK2 have the same period, such that the phases of the first clock signal CLK1 and the second clock signal CLK2 do not overlap with each other. For example, when a period in which a scan signal is supplied to one scan line is referred to as one horizontal period 1H, each of the clock signals CLK1 and CLK2 has a period of 2H, and the clock signals CLK1 and CLK2 are supplied in different horizontal periods.

Although a case where two clock signals are supplied to the scan driver 100 is illustrated in FIG. 2, the number of clock signals supplied to the scan driver 100 is not limited thereto. For example, three or more clock signals may be provided to the scan driver 100 depending on the configuration of a stage.

In an exemplary embodiment, the first clock signal CLK1 and the second clock signal CLK2 may have an overdriving pulse, as described in more detail herein.

Additionally, the stages ST1 to ST4 are supplied with a first voltage VGL and a second voltage VGH. The first voltage VGL and the second voltage VGH may have DC voltage levels. The second voltage VGH may have a value higher than that of the first voltage VGL.

In an exemplary embodiment, the first voltage VGL may be set to a gate-on voltage, and the second voltage VGH may be set to a gate-off voltage. For example, when the pixel P and the scan driver 100 are configured with P-channel Metal Oxide Semiconductor (PMOS) transistors, the first voltage VGL may correspond to a logic low level, and the second voltage VGH may correspond to a logic high level. However, this is merely illustrative, and the first voltage VGL and the second voltage VGH are not limited thereto. For example, the first voltage VGL and the second voltage VGH may be set according to the type of transistor, the service environment of an organic light emitting display device, etc. For example, when the pixel P and the scan driver 100 are configured with N-channel Metal Oxide Semiconductor (NMOS) transistors, the first voltage VGL may be set to a gate-off voltage, and the second voltage VGH may be set to a gate-on voltage.

Figure 3:
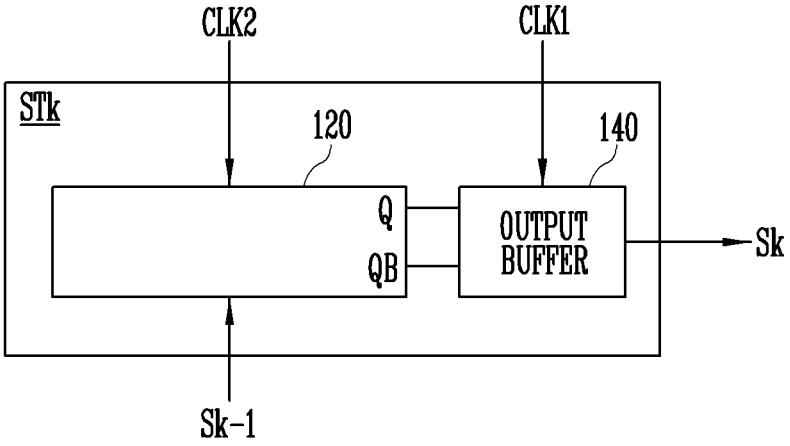
FIG. 3 is a block diagram of an exemplary embodiment of a representative stage included in the scan driver shown in FIG. 2.
Figure 4:
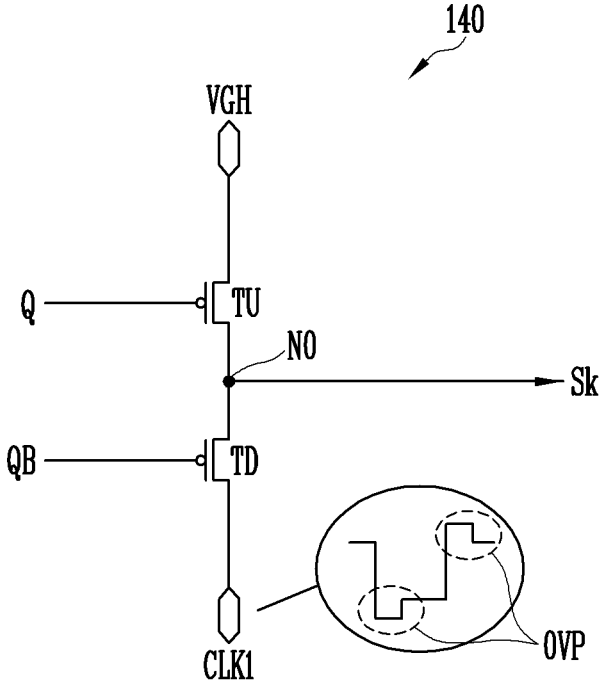
FIG. 4 is a circuit diagram of an exemplary embodiment of an output buffer included in the stage shown in FIG. 3.

FIG. 3 is a block diagram of an exemplary embodiment of a representative stage included in the scan driver shown in FIG. 2. FIG. 4 is a circuit diagram of an exemplary embodiment of an output buffer included in the stage shown in FIG. 3.

Referring to FIGS. 1 to 4, a kth (k is a natural number of n or less) stage STk may include a node controller 120 and an output buffer 140.

The node controller 120 may include a plurality of transistors and at least one capacitor, which control voltages of first and second nodes Q and QB in response to an output signal (carry signal such as Sk-1) of a previous stage. The node controller 120 may apply the gate-off voltage to a first node Q and apply the gate-on voltage to a second node QB, in response to the carry signal Sk-1 and the second clock signal CLK2. The gate-off voltage to the first node Q may be the second voltage VGH since the corresponding transistor TU is a PMOS transistor as shown in FIG. 4.

The output buffer 140 receives one of the first and second clock signals CLK1 and CLK2 provided from the timing controller 500.

The output buffer 140 may apply the first clock signal CLK1 to an output terminal NO when a voltage of the second node QB has the gate-on voltage. The gate-on voltage to the second node QB may be the first voltage VGL since the corresponding transistor TD is a PMOS transistor as shown in FIG. 4. Also, the output buffer 140 may decrease the voltage of the output node NO to the gate-on voltage when the voltage of the second node QB is decreased. In an example, the output buffer 140 may include a pull-up transistor TU and a pull-down transistor TD as shown in FIG. 4.

The pull-up transistor TU may be turned on or turned off according to a voltage state of the first node Q, and apply the second voltage VGH to the output terminal NO when the pull-up transistor TU is turned on.

The pull-down transistor TD may be turned on or turned off according to a voltage state of the second node QB, and apply the first clock signal CLK1 to the output terminal NO when the pull-down transistor TD is turned on.

The first clock signal CLK1 and the second clock signal CLK2 may have an overdriving pulse OVP, as shown schematically in FIG. 4. In an exemplary embodiment, the clock signals CLK1 and CLK2 may have the first voltage VGL that is the gate-on voltage and the second voltage VGH that is the gate-off voltage.

In an exemplary embodiment, the overdriving pulse OVP may include an undershoot voltage applied when the voltage is changed from the second voltage VGH to the first voltage VGL and an overshoot voltage applied when the voltage is changed from the first voltage VGL to the second voltage VGH.

The undershoot voltage may allow a falling time of a scan signal Sk to be shortened, and the overshoot voltage may allow a rising time of the scan signal Sk to be shortened. Accordingly, the full-on time length (magnitude and duration (width) of the scan signal Sk can be assured. In particular, in the case of a high-resolution display panel or driving at a high frequency higher than 60 Hz, the length of one horizontal period 1H is shortened, and therefore, it is important to secure a sufficient full-on time by minimizing the falling time and the rising time.

However, when the overdriving pulse OVP is equally applied to all scan signals (i.e., all stages), the output of a scan signal may be changed depending on the position of a scan line.

For example, an RC delay may occur due to resistance of a signal line for transferring the clock signals CLK1 and CLK2 and capacitance with other lines. The RC delay may be changed depending on equivalent resistance and equivalent capacitance at a corresponding position. For example, the RC delay increases when the distance between the timing controller 500 and the stage receiving the clock signals CLK1 and CLK2 increases.

Therefore, when the overdriving pulse OVP is set based on the worst case where the RC delay is largest, overcharge/overdischarge may occur in a stage disposed relatively close to the timing controller 500, and image noise may occur.

In the display device 1000 according to the exemplary embodiment, the width of the overdriving pulse of the clock signals CLK1 and CLK2 can be adjusted according to distances between stages (and scan lines) and the timing controller 500, i.e., pixel rows. Accordingly, a scan signal having a relatively sufficient pull-on time can be stably output from all the scan lines.

Figure 5:
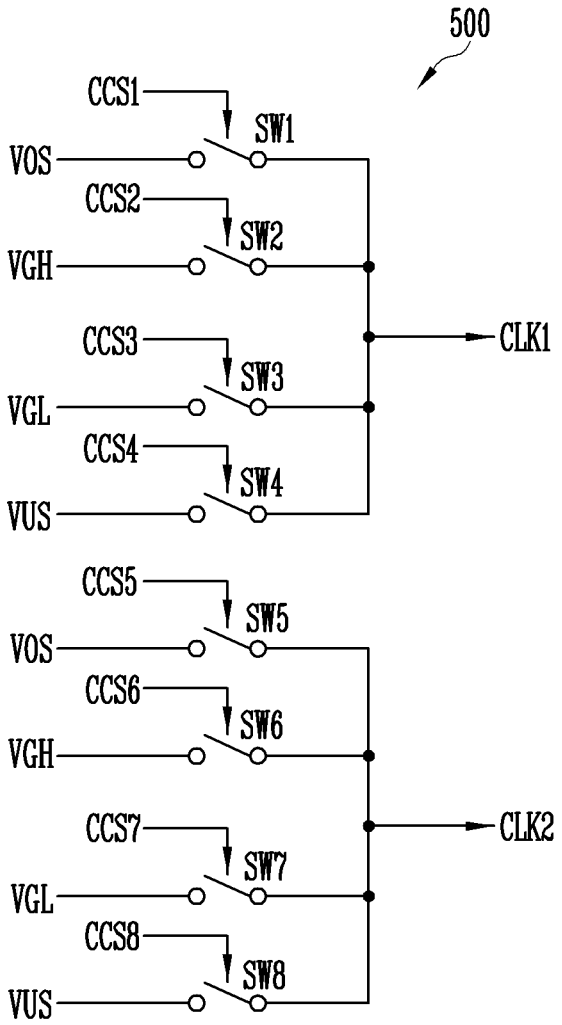
FIG. 5 is a circuit diagram of an exemplary embodiment of a timing controller included in the display device shown in FIG. 1.
Figure 6:
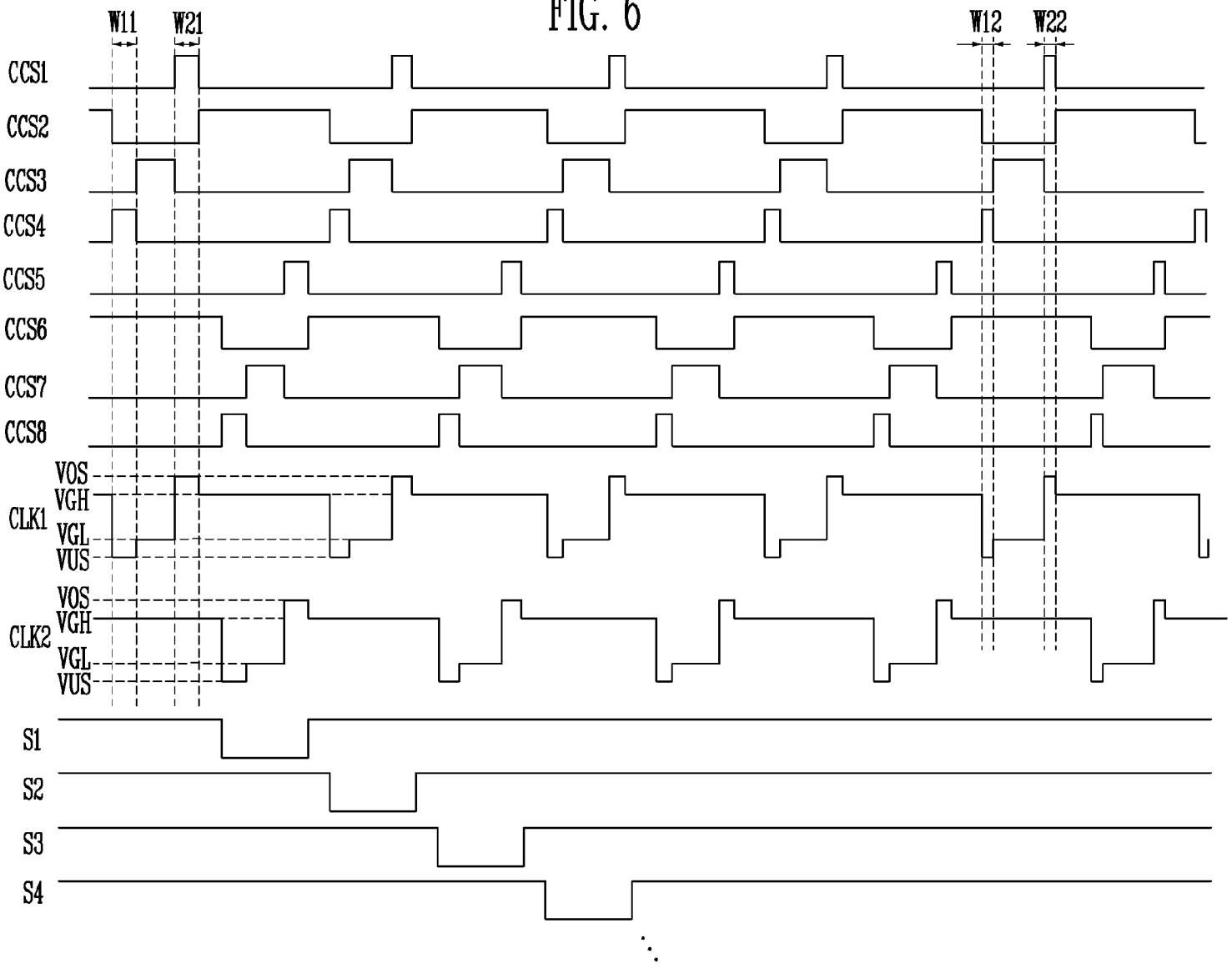
FIG. 6 is a waveform diagram of an exemplary embodiment of clock control signals, clock signals supplied to the scan driver and scan signals supplied to the scan lines included in the display device shown in FIG. 1.

FIG. 5 is a circuit diagram of an exemplary embodiment of the timing controller included in the display device shown in FIG. 1. FIG. 6 is a waveform diagram of an exemplary embodiment of clock control signals (CCS1 to CCS8) and clock signals (CLK1, CLK2) supplied to the scan driver included in the display device shown in FIG. 1 and scan signals (S1 to S4) to the scan lines.

Referring to FIGS. 1, 2, 5, and 6, the timing controller 500 may control an overdriving width of first and second clock signals CLK1 and CLK2 supplied to the scan driver 100 when time elapses.

In an exemplary embodiment, the timing controller 500 may include a plurality of switches SW1 to SW8 as shown in FIG. 5, which control the voltage change timings of the first and second clock signals CLK1 and CLK2 in response to a plurality of clock control signals CCS1 to CCS8.

First to fourth switches SW1 to SW4 and first to fourth clock control signals CCS1 to CCS4 are components for controlling a waveform (voltage change timing) of the first clock signal CLK1, and fifth to eighth switches SW5 to SW8 and fifth to eighth clock signals CCS5 to CCS8 are components for controlling a waveform (voltage change timing) of the second clock signal CLK2.

The second clock signal CLK2 may have the substantially same period as the first clock signal CLK1. The second clock signal CLK2 may be a signal obtained by shifting the first clock signal CLK1 by a preset time.

The first and second clock signals CLK1 and CLK2 may have a first voltage VGL, a second voltage VGH, an overshoot voltage VOS, and an undershoot voltage VUS. The overshoot voltage VOS of the first clock signal CLK1 may be controlled by the first clock control signal CCS1, the first voltage VGL of the first clock signal CLK1 may be controlled by the third clock control signal CCS3, the second voltage VGH of the first clock CLK1 may be controlled by the second clock control signal CCS2, and the undershoot voltage VUS of the first clock signal CLK1 may be controlled by the fourth clock control signal CCS4.

The first switch SW1 may be turned on in response to the first clock control signal CCS1, and the first clock signal CLK1 may be output as the overshoot voltage VOS.

The second switch SW2 may be turned on in response to the second clock control signal CCS2, and the first clock signal CLK1 may be output as the second voltage VGH.

The third switch SW3 may be turned on in response to the third clock control signal CCS3, and the first clock signal CLK1 may be output as the first voltage VGL.

The fourth switch SW4 may be turned on in response to the fourth clock control signal CCS4, and the first clock signal CLK1 may be output as the undershoot voltage VUS.

In an exemplary embodiment, gate-on voltage (i.e., switch turn on voltage) sections of the first to fourth clock control signals CCS1 to CCS4 do not overlap with each other. For example, when each of the first to eight switches (SW1 to SW8) is a NMOS transistor, the rising time of the fourth clock control signal CCS4 and the falling time of the second clock control signal CCS2 may be synchronized with each other, and the falling time of the fourth clock control signal CCS4 and the rising time of the third clock control signal CCS3 may be synchronized with each other. In addition, the rising time of the first clock control signal CCS1 and the falling time of the third clock control signal CCS3 may be synchronized with each other, and the falling time of the first clock control signal CCS1 and the rising time of the second clock control signal CCS2.

As shown in FIG. 6, the gate-on voltage of the first to fourth clock control signals CCS1 to CCS4 may be a logic high level when the first to fourth switches (SW1 to SW4) are NMOS transistors. However, this is merely illustrative, and the gate-on voltage of the first to fourth clock control signals CCS1 to CCS4 may be a logic low level according to a type of the first to fourth switches SW1 to SW4 (e.g., PMOS transistors).

The overdriving width of an overdriving pulse of the first clock signal CLK may correspond to either an undershoot section having the undershoot voltage VUS or an overshoot section having the overshoot voltage VOS.

In an exemplary embodiment, the overdriving width may be decreased when time elapses in one frame period, i.e. from the time of supplying the first scan signal to the time of supplying the nth scan signal in one frame period. That is, in the one frame period, a width W11 of an initial undershoot section and a width W21 of an initial overshoot section may be wider than a width W12 of a subsequent undershoot section and a width W22 of a subsequent overshoot section. The distance between a first scan line SL1 and the timing controller 500 may be longer than that between an nth scan line SLn and the timing controller 500. That is, an RC delay in signal lines that transfer the first and second clock signals CLK1 and CLK2 to the first stage ST1 coupled to the first scan line SL1 may be greater than that in signal lines that transfer the first and second clock signals CLK1 and CLK2 to the nth stage STn coupled to the nth scan line SLn.

In order to reflect the difference in RC delay, an overdriving width corresponding to an output of the nth scan line SLn may be narrower than that corresponding to an output of the first scan line SL1. Therefore, the overdriving width may be decreased in a preset or predetermined period when time elapses in the one frame period.

In an exemplary embodiment, the first and second clock signals CLK1 and CLK2 corresponding to an output timing of the nth scan line SLn may not have any overdriving pulse. For example, when the RC delay between the nth stage STn and the timing controller 500 is very small, the first and second clock signals CLK1 and CLK2 corresponding to the output timing of the nth scan line SLn may not have any overdriving pulse so as to prevent occurrence of a glitch caused by overdriving pulses of the first and second clock signals CLK1 and CLK2.

In an exemplary embodiment, the width of an overdriving pulse may correspond to the width of the gate-on voltage section of the first clock control signal CCS1 and the width of the gate-on voltage section of the fourth clock control signal CCS4. For example, the width of the undershoot voltage section may correspond to that of the gate-on voltage section of the fourth clock control signal CCS4, and the width of the overshoot voltage section may correspond to that of the gate-on voltage section of the first clock control signal CCS1.

As shown in FIG. 6, the first clock signal CLK1 and the second clock signal CLK2 may alternately correspond to outputs of scan signals S1 to S4. A scan signal may be sequentially applied from the first scan line SL1 to the nth scan line SLn when time elapses in one frame period.

An output method of the second clock signal CLK2 is substantially identical to that of the first clock signal CLK1, and therefore, repetitive descriptions will be omitted to avoid redundancy.

As described above, in the display device 1000 according to the exemplary embodiment, the width of at least one of the undershoot voltage section and the overshoot voltage section in one frame period may be decreased according to the distances between stages (and scan lines) and the timing controller 500. For example, when a stage becomes close to a controller (e.g., the timing controller 500) that supplies a clock signal, an overdriving time (i.e., an overdriving width) corresponding to the stage may be shortened. Thus, unnecessary overcharge with respect to an output of a scan line relatively close to the timing controller 500 can be prevented, and power consumption due to overdriving can be reduced. In addition, noise of a scan signal is reduced, and scan signal outputs of all the scan lines are equalized, so that image quality can be improved.

Figure 7:
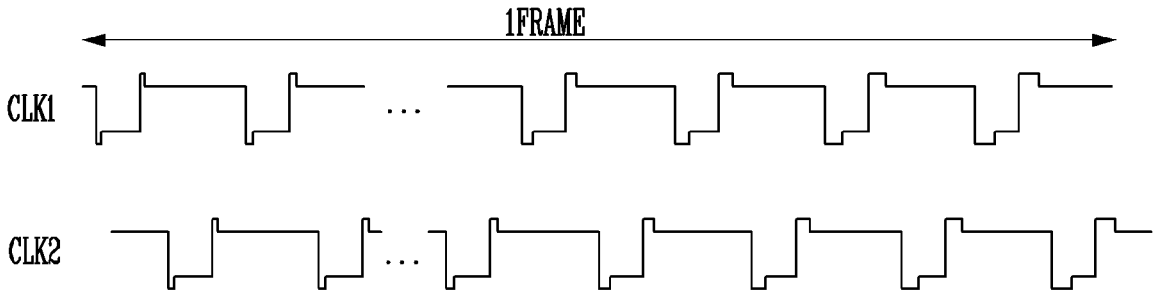
FIG. 7 is a waveform diagram of an exemplary embodiment of clock signals supplied to the scan driver included in the display device shown in FIG. 1.

FIG. 7 is a waveform diagram of an exemplary embodiment of the clock signals supplied to the scan driver included in the display device shown in FIG. 1.

FIGS. 1 to 4 and 7, the overdriving width of an overdriving pulse of the first and second clock signals CLK1 and CLK2 supplied to the scan driver 100 may be increased when time elapses in one frame period.

In the one frame period, an overdriving width corresponding to the first scan line SL1 and the first stage ST1 coupled thereto is smallest, and an overdriving width corresponding to the nth scan line SLn and the nth stage STn coupled thereto may be largest when the distance between the first scan line SL1 (and the first stage ST1) and the timing controller 500 is shorter than that between the nth scan line SLn (and the nth stage STn) and the timing controller 500. A scan signal may be sequentially output from the first scan line SL1 to the nth scan line SLn, corresponding to the first and second clock signals CLK1 and CLK2.

In an exemplary embodiment, when a scan direction is a direction from the nth scan line SLn to the first scan line SL1 in the clock signals CLK1 and CLK2 shown in FIG. 7, that is, when the distance between the nth scan line SLn (and the nth stage STn) and the timing controller 500 is shorter than that between the first scan line SL1 (and the first stage ST1) and the timing controller 500, an overdriving width corresponding to the output of the nth scan line SLn may be smallest, and an overdriving width corresponding to the output of the first scan line SL1 may be largest.

Figure 8:
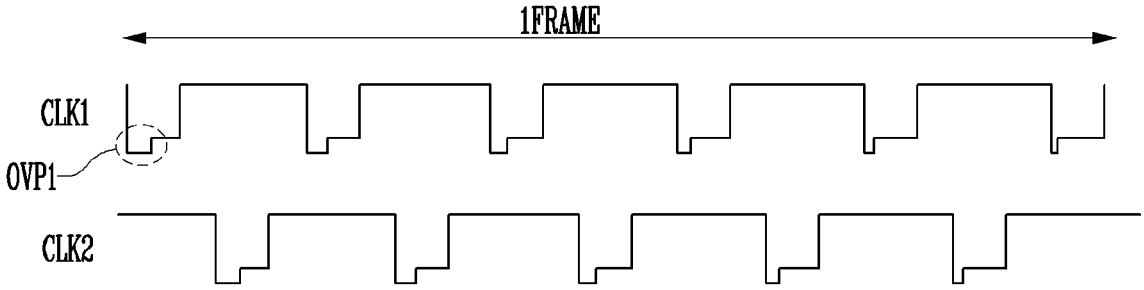
FIG. 8 is a waveform diagram of another exemplary embodiment of clock signals supplied to the scan driver included in the display device shown in FIG. 1.
Figure 9:
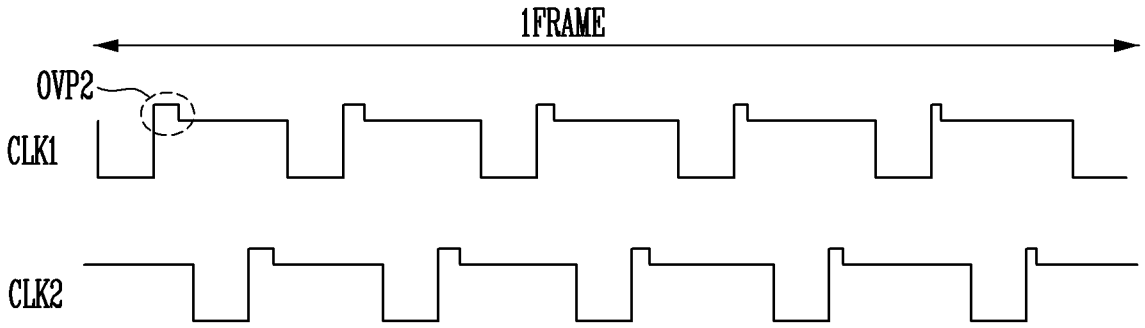
FIG. 9 is a waveform diagram of still another exemplary embodiment of clock signals supplied to the scan driver included in the display device shown in FIG. 1.

FIG. 8 is a waveform diagram of another exemplary embodiment of the clock signals supplied to the scan driver included in the display device shown in FIG. 1. FIG. 9 is a waveform diagram of still another exemplary embodiment of the clock signals supplied to the scan driver included in the display device shown in FIG. 1.

The clock signals according to the exemplary embodiments are similar to those shown in FIG. 6 except overdriving pulses, and therefore, repetitive descriptions will be omitted to avoid redundancy.

Referring to FIGS. 1, 6, 8, and 9, the overdriving widths of overdriving pulses OVP1 and OVP2 of the first and second clock signals CLK1 and CLK2 may be decreased when time elapses in one frame period.

In the one frame period, an overdriving width corresponding to the first scan line SL1 and the first stage ST1 coupled thereto is largest, and an overdriving width corresponding to the nth scan line SLn and the nth stage STn coupled thereto may be smallest. In this case, the distance between the first scan line SL1 (and the first stage ST1) and the timing controller 500 is may be longer than that between the nth scan line SLn (and the nth stage STn) and the timing controller 500. In an exemplary embodiment, the clock signal corresponding to an output of the nth scan line SLn does not have any overdriving pulse.

In an exemplary embodiment, as shown in FIG. 8, the overdriving pulse OVP1 may have only an undershoot voltage section. A falling transition time of a scan signal may be shortened.

In an exemplary embodiment, as shown in FIG. 9, the overdriving pulse OVP2 may have only an overshoot voltage section. A rising transition time of a scan signal may be shortened.

Figure 10:
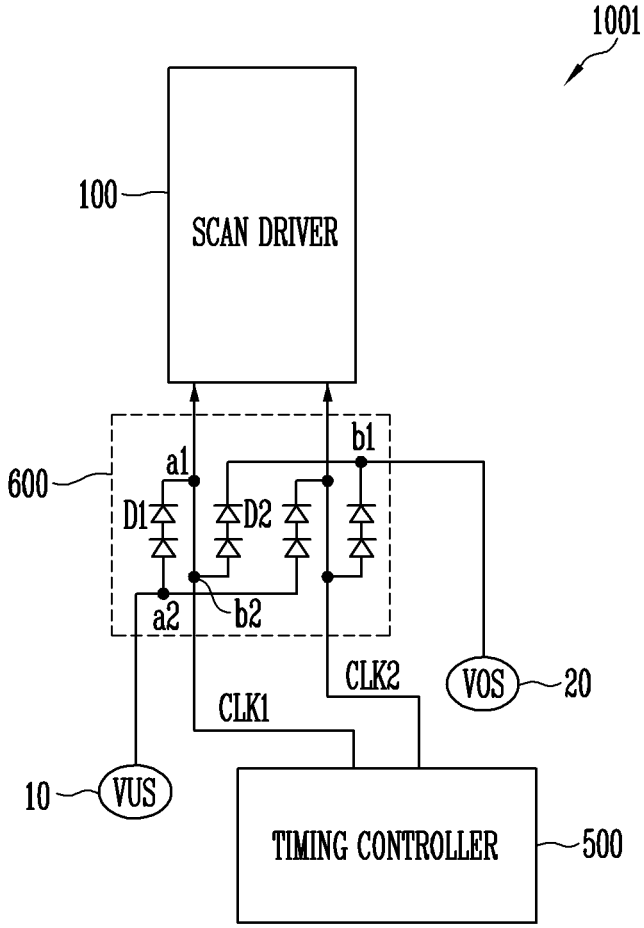
FIG. 10 is a schematic block diagram of an exemplary embodiment of the display device shown in FIG. 1.

FIG. 10 is a schematic block diagram of an exemplary embodiment of the display device shown in FIG. 1.

The display device of the illustrated exemplary embodiment is identical to the display device shown in FIG. 1 except a configuration of an electrostatic discharge protector. Therefore, components identical or corresponding to those of the display device shown in FIG. 1 are designated by like reference numerals, and repetitive descriptions will be omitted to avoid redundancy.

Referring to FIGS. 1, 6, and 10, the display device 1001 may include a display panel 200, a scan driver 100, an emission driver 300, a data driver 400, a timing controller 500, and an electrostatic discharge protector 600.

The electrostatic discharge protector 600 may be coupled to a clock signal line that transfers clock signals CLK1 and CLK2 to the scan driver 100 from the timing controller 500.

The electrostatic discharge protector 600 may be configured with a plurality of diodes or diode-coupled transistors.

In an exemplary embodiment, the electrostatic discharge protector 600 may include a first diode D1 including a first terminal al coupled to the clock signal (e.g., first clock signal CLK1) line and a second terminal a2 coupled to a first voltage source 10 that supplies an undershoot voltage VUS, and a second diode D2 including a first terminal b1 coupled to a second voltage source 20 that supplies an overshoot voltage VOS and a second terminal b2 coupled to the clock signal (e.g., second clock signal CLK2) line.

The clock signals CLK1 and CLK2 may have an overdriving pulse, and the overdriving pulse may include the undershoot voltage VUS and the overshoot voltage VOS. Therefore, a voltage between the undershoot voltage VUS and the overshoot voltage VOS may be applied to the clock signal line.

If the first diode D1 does not couple to the first voltage source 10 and a voltage source having a voltage higher than the undershoot voltage VUS is coupled to the second terminal a2 of the first diode D1, the undershoot voltage VUS of the overdriving pulse may be discharged through the electrostatic discharge protector 600. In addition, if the second diode D2 does not couple to the second voltage source 20 when a voltage source having a voltage higher than the overshoot voltage VOS is coupled to the first terminal b1 of the second diode D2, the overshoot voltage VOS of the overdriving pulse may be discharged through the electrostatic discharge protector 600. Accordingly, in these situations, the overdriving pulse of the clock signals CLK1 and CLK2 may be removed.

In order to prevent these situations, the undershoot voltage VUS and a voltage lower than the undershoot voltage VUS such as the first voltage source 10 may be applied to the second terminal a2 of the first diode D1, and the overshoot voltage VOS or a voltage higher than is the overshoot voltage VOS such as the second voltage source 20 may be applied to the first terminal b1 of the second diode D2.

Figure 11:
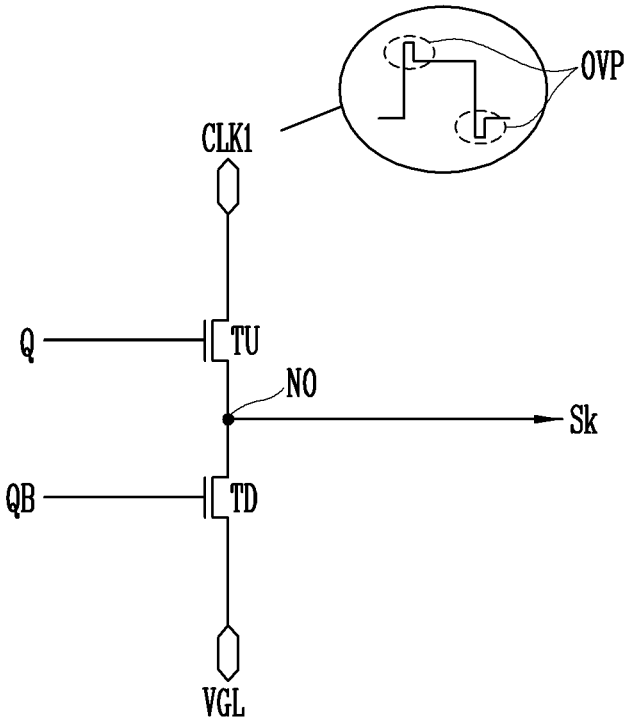
FIG. 11 is a circuit diagram of another exemplary embodiment of the output buffer included in the stage shown in FIG. 3.

FIG. 11 is a circuit diagram of another exemplary embodiment of the output buffer included in the stage shown in FIG. 3.

The output buffer according to the illustrated exemplary embodiment is identical to the output buffer shown in FIG. 4 except a configuration of transistors and a signal waveform. That is, a pull-up transistor TU and a pull-down transistor TD in FIG. 11 are NMOS transistors. Therefore, components identical or corresponding to those of the output buffer shown in FIG. 4 are designated by like reference numerals, and repetitive descriptions will be omitted to avoid redundancy.

Referring to FIGS. 1, 3, and 11, the output buffer 140 may include a pull-up transistor TU and a pull-down transistor TD.

The pull-up transistor TU may be turned on or turned off according to a voltage state of a first node Q, and apply the first clock signal CLK1 to an output terminal NO when the pull-up transistor TU is turned on.

The pull-down transistor TD may be turned on or turned off according to a voltage state of a second node QB, and apply the first voltage VGL to the output terminal NO when the pull-down transistor TD is turned on.

The pull-up transistor TU and the pull-down transistor TD may be implemented with an NMOS transistor. The gate-on voltage of the first and second clock signals CLK1 and CLK2 may be the logic high level, and the gate-on voltage of the scan signal Sk may also be the logic high level.

The first clock signal CLK1 and the second clock signal CLK2 may have an overdriving pulse OVP. In an exemplary embodiment, the clock signals CLK1 and CLK2 may have the second voltage VGH that is the gate-on voltage and the first voltage VGL that is the gate-off voltage.

The overdriving pulse OVP may include an undershoot voltage applied when it is changed from the second voltage VGH to the first voltage VGL and an overshoot voltage applied when it is changed from the first voltage VGL to the second voltage VGH.

Figure 12:
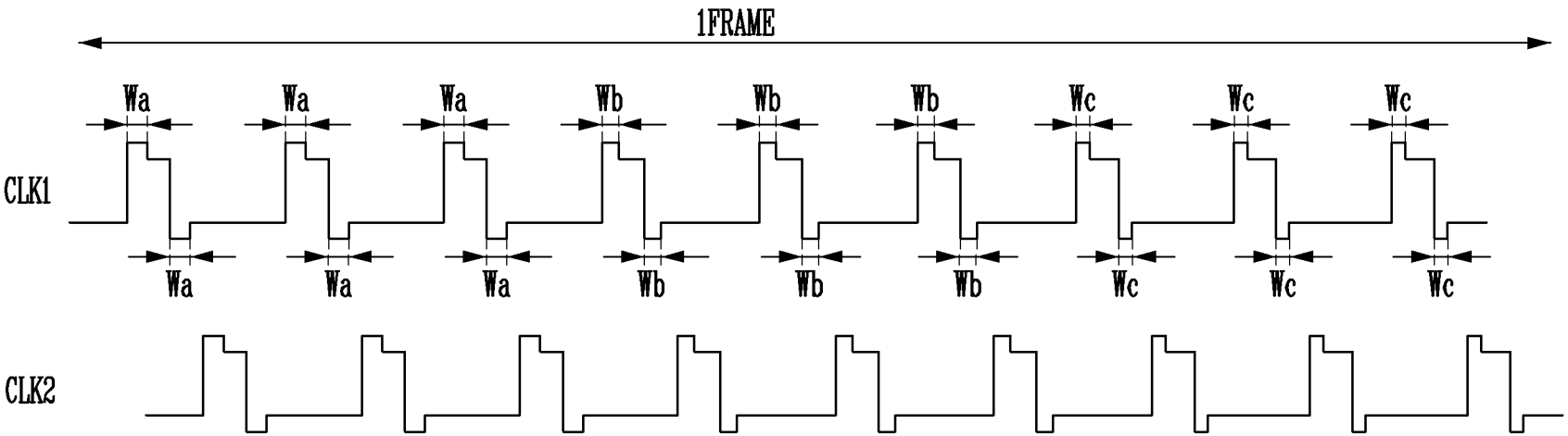
FIG. 12 is a waveform diagram of an exemplary embodiment of clock signals supplied to the scan driver included in the display device shown in FIG. 1.

FIG. 12 is a waveform diagram of an exemplary embodiment of the clock signals supplied to the scan driver included in the display device shown in FIG. 1.

Referring to FIGS. 11 and 12, an overdriving width may be decreased when time elapses in one frame period.

In an exemplary embodiment, the overdriving width may be decreased at a preset clock signal number interval. For example, as shown in FIG. 12, the overdriving width such as Wa, Wb and Wc may be decreased using three clock pulses as a period. In other words, the first 3 clock signals have first overdriving width Wa, the next 3 clock signals have second overdriving width Wb, and the next 3 clock signals have third overdriving width Wc. The first overdriving width Wa is larger than the second overdriving width Wb, and the second overdriving width Wb is larger than the third overdriving width Wc.

The clock signals CLK1 and CLK2 shown in FIG. 12 have waveforms substantially identical to those of the clock signals shown in FIGS. 6 and 7 except that the gate-on voltage is the second voltage VGH, and therefore, repetitive descriptions will be omitted to avoid redundancy.

Figure 13:
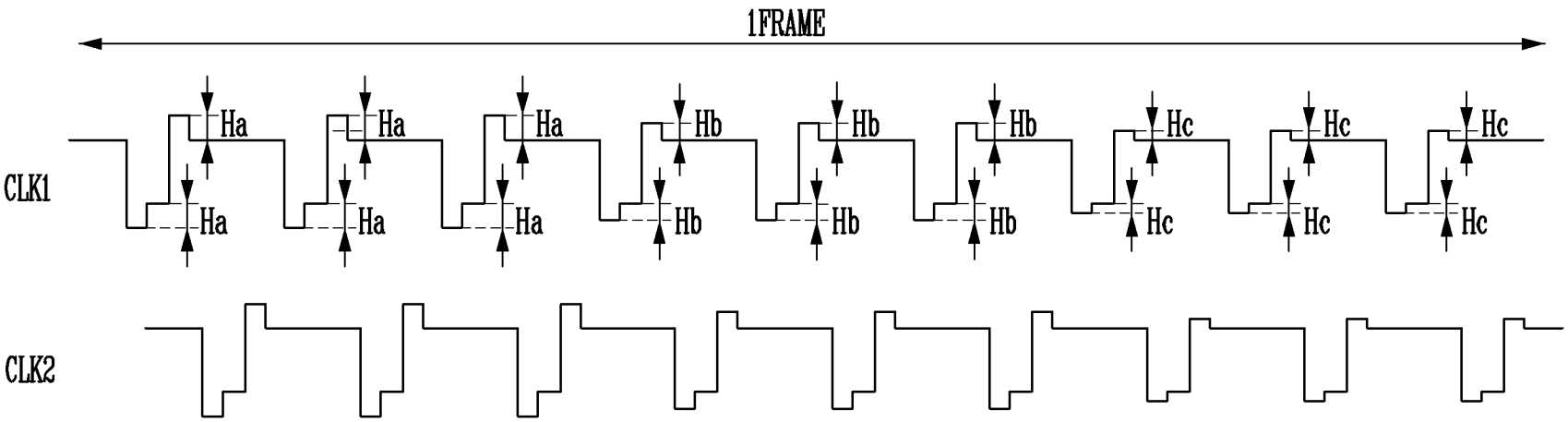
FIG. 13 is a waveform diagram of another exemplary embodiment of clock signals supplied to the scan driver included in the display device shown in FIG. 1.
Figure 14:
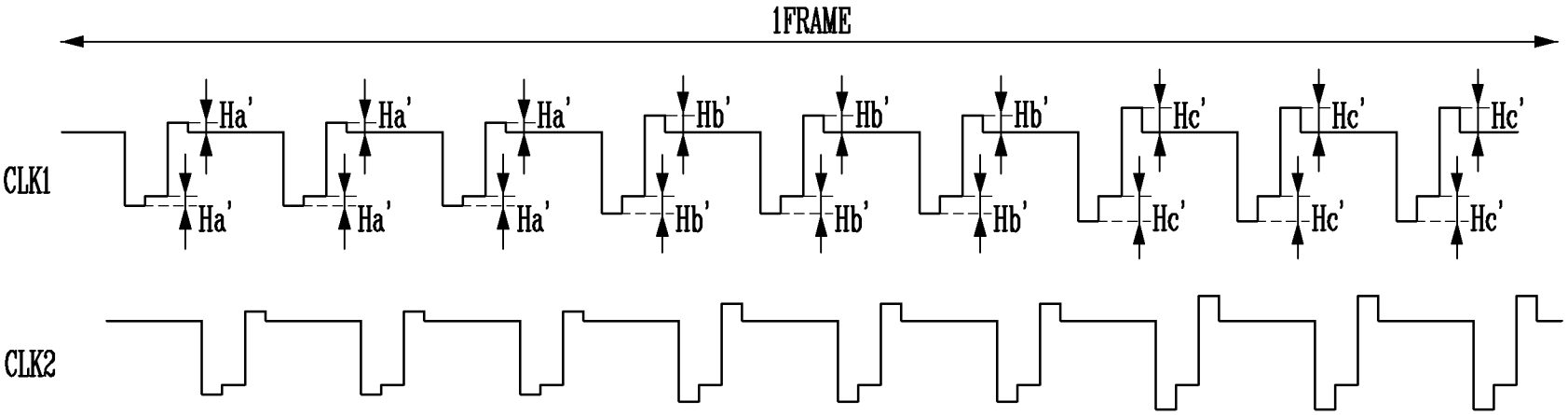
FIG. 14 is a waveform diagram of still another exemplary embodiment of clock signals supplied to the scan driver included in the display device shown in FIG. 1.

FIG. 13 is a waveform diagram of another exemplary embodiment of the clock signals supplied to the scan driver included in the display device shown in FIG. 1. FIG. 14 is a waveform diagram of still another exemplary embodiment of the clock signals supplied to the scan driver included in the display device shown in FIG. 1.

Referring to FIGS. 1 to 4, 13, and 14, the magnitude of an undershoot voltage of each of the clock signals CLK1 and CLK2 and the magnitude of an overshoot voltage of each of the clock signals CLK1 and CLK2 may be changed when time elapses in one frame period.

As shown in FIG. 13, in an exemplary embodiment, the undershoot voltage may be increased and the overshoot voltage may be decreased when time elapses in the one frame period. For example, when a scan direction is a direction from the first scan line SL1 to the nth scan line SLn, an undershoot voltage corresponding to an output of the first scan line SL1 may be lower than that corresponding to an output of the nth scan line SLn. Similarly, an overshoot voltage corresponding to the output of the first scan line SL1 may be larger than that corresponding to the output of the nth scan line SLn.

The distance between the first scan line SL1 (and the first stage ST1) and the timing controller 500 may be longer than that between the nth scan line SLn (and the nth stage STn) and the timing controller 500. That is, an RC delay with respect to a clock signal CLK1 or CLK2 corresponding to the output of the first scan line SL1 may be larger than that with respect to a clock signal CLK1 or CLK2 corresponding to the output of the nth scan line SLn.

That is, the magnitude of the absolute value of an overdriving voltage may be decreased when time elapses in the one frame period. For example, as shown in FIG. 13, the overdriving magnitude such as Ha, Hb and Hc may be decreased using three clock pulses as a period. In other words, the first 3 clock signals have first overdriving magnitude Ha, the next 3 clock signals have second overdriving magnitude Hb, and the next 3 clock signals have third overdriving magnitude Hc. The first overdriving magnitude Ha is larger than the second overdriving magnitude Hb, and the second overdriving magnitude Hb is larger than the third overdriving magnitude Hc.

On the contrary, as shown in FIG. 14, in an exemplary embodiment, the undershoot voltage may be decreased and the overshoot voltage may be increased when time elapses in the one frame period. For example, when the scan direction is a direction from the first scan line SL1 to the nth scan line SLn, an undershoot voltage corresponding to the output of the first scan line SL1 may be larger than that corresponding to the output of the nth scan line SLn. Similarly, an overshoot voltage corresponding to the output of the first scan line SL1 may be lower than that corresponding to the output of the nth scan line SLn.

The distance between the first scan line SL1 (and the first stage ST1) and the timing controller 500 may be shorter than that between the nth scan line SLn (and the nth stage STn) and the timing controller 500. That is, an RC delay with respect to a clock signal CLK1 or CLK2 corresponding to the output of the first scan line SL1 may be smaller than that with respect to a clock signal CLK1 or CLK2 corresponding to the output of the nth scan line SLn.

That is, the magnitude of the absolute value of the overdriving voltage may be decreased when time elapses in the one frame period. For example, as shown in FIG. 14, the overdriving magnitude such as Ha', Hb' and Hc' may be increased using three clock pulses as a period. In other words, the first 3 clock signals have first overdriving magnitude Ha', the next 3 clock signals have second overdriving magnitude Hb', and the next 3 clock signals have third overdriving magnitude Hc'. The first overdriving magnitude Ha' is smaller than the second overdriving magnitude Hb', and the second overdriving magnitude Hb' is smaller than the third overdriving magnitude Hc'. Of course, the number of clock signals have the same amount of overdriving magnitude or duration may be changed from the example of 3 given above.

Accordingly, when a stage (scan line) becomes close to a controller (e.g., the timing controller 500) that supplies a clock signal, an overdriving voltage (i.e., a difference between the overdriving voltage and the gate-on/off voltage) corresponding to the stage (scan line) may be decreased.

Each of the first and second voltages VGL and VGH of the clock signals CLK1 and CLK2 may maintain a constant voltage level, regardless of a change in overdriving voltage.

As described above, in the display device 1000, the magnitude of an overdriving voltage of the clock signals CLK1 and CLK2 is adjusted according to distances between stages (and scan lines) and the timing controller 500. Thus, unnecessary overcharge with respect to an output of a scan line relatively close to the timing controller 500 can be reduced or prevented, and power consumption due to overdriving can be reduced. In addition, noise of a scan signal is reduced, and scan signal outputs of all the scan lines are equalized, so that image quality can be improved.

In the display device according to the other exemplary embodiments, an overdriving time (i.e., an overdriving width) of clock signals related to a scan signal output can be controlled based on distances between a controller (i.e., the timing controller) that supplies the clock signals and stages (and/or scan lines) of the scan driver. Thus, unnecessary overcharge with respect to an output of a scan line relatively close to the controller can be reduced or prevented, and power consumption due to unnecessary overdriving can be reduced. In addition, noise of a scan signal may be reduced, and the scan signal output variation of all the scan lines may be minimized, so that image quality can be improved.

Further, in the display device according to some exemplary embodiments, the magnitude of an overdriving voltage of the clock signals is adjusted based on distances between stages (and scan lines) and the controller. Thus, unnecessary overcharge with respect to an output of a scan line relatively close to the controller can be reduced or prevented, and power consumption due to overdriving can be reduced. In addition, noise of a scan signal may be reduced, and the scan signal output variation of all the scan lines may be minimized, so that image quality can be improved.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel having a plurality of pixels coupled to respective ones of first to nth (where n is a natural number greater than 1) scan lines;

a scan driver having a plurality of stages to supply a scan signal to the first to nth scan lines; and a timing controller to provide a clock signal having variable overdriving pulses to the scan driver and to control the scan driver by controlling the overdriving pulses, wherein a first overdriving pulse of the clock signal corresponding to a first scan signal has a first width and an nth overdriving pulse of the clock signal corresponding to the nth scan signal has a nth width different from the first width.

2. The display device of claim 1, wherein each of the overdriving pulses has an overdriving width that decreases from the time of supplying the first scan signal to the time of supplying the nth scan signal.

3. The display device of claim 1, wherein each of the overdriving pulses has an overdriving width that increases from the time of supplying the first scan signal to the time of supplying the nth scan signal.

4. The display device of claim 1, wherein the first overdriving pulse of the clock signal has a first overdriving width that is greater than the nth overdriving pulse of the clock signal.

5. The display device of claim 4, wherein a distance between the first scan line and the timing controller is greater than that between the nth scan line and the timing controller.

6. The display device of claim 1, wherein the first overdriving pulse of the clock signal has a first overdriving width that is smaller than nth overdriving pulse of the clock signal.

7. The display device of claim 6, wherein a distance between the first scan line and the timing controller is shorter than that between the nth scan line and the timing controller.

8. The display device of claim 1, wherein the clock signal comprises a first voltage and a second voltage greater than the first voltage, wherein the overdriving pulse of the clock signal includes an undershoot voltage lower than the first voltage and an overshoot voltage higher than the second voltage.

9. The display device of claim 8, wherein the width of at least one of an undershoot voltage section and an overshoot voltage section is decreased from the time of supplying the first scan signal to the time of supplying the nth scan signal.

10. The display device of claim 9, wherein the timing controller comprises:

a plurality of switches to control a transition timing of the clock signal in response to a plurality of clock control signals.

11. The display device of claim 10, wherein the undershoot voltage corresponding to the first scan line is lower than that corresponding to the nth scan line.

12. The display device of claim 11, wherein the overshoot voltage corresponding to the first scan line is greater than that corresponding to the nth scan line.

13. The display device of claim 11, wherein a distance between a first stage coupled to the first scan line and the timing controller is greater than that between an nth stage coupled to the nth scan line and the timing controller.

14. The display device of claim 8, wherein a magnitude of the undershoot voltage and a magnitude of the overshoot voltage changes from the time of supplying the first scan signal to the time of supplying the nth scan signal in one frame period.

15. The display device of claim 14, wherein each of the first voltage and the second voltage maintains a substantially constant voltage level.

16. The display device of claim 8, further comprising:

an electrostatic discharge protector coupled to a clock signal line to transfer the clock signal to the scan driver from the timing controller.

17. The display device of claim 16, wherein the electrostatic discharge protector comprises:

a first diode having a first terminal coupled to the clock signal line and a second terminal coupled to a first voltage source to supply the undershoot voltage; and a second diode having a first terminal coupled to a second voltage source to supply the overshoot voltage and a second terminal coupled to the clock signal line.

18. A display device comprising:

a display panel having a plurality of pixels coupled to respective ones of first to nth (where n is a natural number greater than 1) scan lines;

a scan driver having a plurality of stages to supply a scan signal to the first to nth scan lines; and a timing controller to provide a clock signal having variable overdriving pulses to the scan driver and to control the scan driver by controlling the overdriving pulses, wherein the clock signal comprises a first voltage and a second voltage greater than the first voltage, wherein the overdriving pulse of the clock signal includes an undershoot voltage lower than the first voltage and an overshoot voltage higher than the second voltage, and wherein the undershoot voltage is increased and the overshoot voltage is decreased from the time of supplying the first scan signal to the time of supplying the nth scan signal in one frame period.

19. A display device comprising:

a display panel having a plurality of pixels coupled to respective ones of first to nth (where n is a natural number greater than 1) scan lines;

a scan driver having a plurality of stages to supply a scan signal to the first to nth scan lines; and a timing controller to control the scan driver by controlling an overdriving pulse of a clock signal supplied to the scan driver, wherein the overdriving pulse includes an undershoot voltage and an overshoot voltage, and wherein an overdriving width of the clock signal corresponding to an output of the first scan line is greater than that of the clock signal corresponding to an output of the nth scan line.

20. The display device of claim 19, wherein a distance between a first stage coupled to the first scan line and the timing controller is greater than that between an nth stage coupled to the nth scan line and the timing controller.

* * * * *